US006749043B2

(12) United States Patent
Brown et al.

(10) Patent No.: US 6,749,043 B2
(45) Date of Patent: Jun. 15, 2004

(54) LOCOMOTIVE BRAKE RESISTOR COOLING APPARATUS

(75) Inventors: Theodore Clark Brown, Ripley, NY (US); Larry G. Andreson, Erie, PA (US); Ian Osborn, Ankeny, IA (US)

(73) Assignee: General Electric Company, Schenectady, NY (US)

( * ) Notice: Subject to any disclaimer, the term of this patent is extended or adjusted under 35 U.S.C. 154(b) by 34 days.

(21) Appl. No.: 10/074,733

(22) Filed: Feb. 13, 2002

(65) Prior Publication Data

US 2003/0075396 A1 Apr. 24, 2003

Related U.S. Application Data

(60) Provisional application No. 60/338,900, filed on Oct. 22, 2001.

(51) Int. Cl.[7] ..... F16D 55/02

(52) U.S. Cl. ..... 188/3 R; 188/71.6

(58) Field of Search ..... 188/71.6, 3 R, 188/264 A, 264 R, 264 F; 303/124; 361/690

(56) References Cited

U.S. PATENT DOCUMENTS

| | | | | |
|---|---|---|---|---|
| 5,110,560 A | * | 5/1992 | Presz et al. | 422/176 |
| 5,517,093 A | | 5/1996 | Augustyniak et al. | |
| 6,081,183 A | | 6/2000 | Mading et al. | |
| 6,309,178 B1 | * | 10/2001 | Kim et al. | 415/176 |
| 6,412,283 B1 | * | 7/2002 | Sheoran et al. | 60/770 |
| 6,430,045 B1 | * | 8/2002 | Everitt | 361/690 |

FOREIGN PATENT DOCUMENTS

DE 3216643 A1 * 11/1983

OTHER PUBLICATIONS

50/60 Hz Axial Fans. www.airscrew.co.uk/5060hzaxial-fan.html.

50/60 Hz Mixed Flow Fans. www.airscrew.co.uk/5060hz-mixedfan.html.

Airscrew Limited—Heating, Ventilation and Cooling Systems. www.railway–technology.com/contractors/hvac/air-screw.

* cited by examiner

*Primary Examiner*—Douglas C. Butler
*Assistant Examiner*—Xuan Lan Nguyen
(74) *Attorney, Agent, or Firm*—Carl Rowold; David G. Maire; Beusse Brownlee Wolter Mora & Maire, P.A.

(57) ABSTRACT

A cooling apparatus (27) for a locomotive dynamic brake resistor grid stack (22) including a flow directing diffuser (24). The flow directing diffuser includes at least one turning vane member (26) disposed at an angle to the flow stream axis for directing a portion of the cooling air from a high velocity area of the air stream into a lower velocity area of the air stream. The flow directing diffuser may include an annular ring-shaped turning vane member (28) for directing high velocity air into a center low velocity area. The flow directing diffuser may further include a V-shaped turning vane member (32) associated with each corner (34) of the surrounding duct (36) for directing high velocity air into each corner low velocity area. Air is supplied to the duct 36 housing the flow directing diffuser by a mixed flow fan (54).

13 Claims, 3 Drawing Sheets

LOCOMOTIVE BRAKE RESISTOR COOLING APPARATUS

This application claims benefit of the Oct. 22, 2001, filing date of U.S. provisional patent application serial No. 60/338,900.

FIELD OF THE INVENTION

This invention relates generally to traction motor dynamic braking systems in locomotives and more particularly to an air-cooled resistor grid package for a dynamic braking system.

BACKGROUND OF THE INVENTION

In a conventional rail locomotive, a diesel engine is used to drive an alternator. The alternator, in turn, supplies electrical current to drive a plurality of electrical traction motors. The traction motors provide the motive force for propelling the locomotive in the forward and reverse directions. In addition to providing a driving force, the traction motors may also perform a braking function. In the braking mode, the traction motors are configured to generate electricity instead of consuming it. As generators, the traction motors convert the kinetic energy of motion of the locomotive into electrical energy, thereby providing a dynamic braking action to slow the movement of the locomotive. The electrical energy generated during dynamic braking can not be used or stored conveniently on-board the locomotive, so it is converted to heat energy by connecting the traction motors to a bank of electrical resistors. Such electrical resistors are commonly called dynamic braking grids. The dynamic braking grids are cooled by fan-driven air, thereby transferring the energy generated by the dynamic braking to the ambient environment.

A typical stack of braking grids may occupying a volume of only about 50 cubic feet and may be used to dissipate approximately 1.8 MW of power. A limiting factor in the amount of dynamic braking force that may be applied to a locomotive is the upper temperature limit of the materials of the dynamic braking grids. The efficient transfer of heat energy from the resistors to the ambient environment is critical to the proper performance of a dynamic braking system. Because the design of the braking grid package is subject to size and noise limitations, it is not always possible to simply increase the number of braking resistors and the size and capacity of the cooling fans.

Working within predetermined design boundaries, it is desirable to minimize hot spots in the braking grids in order to maximize the energy dissipation across the entire grid while avoiding localized material failure. A typical fan will provide a very uneven airflow velocity distribution at the fan outlet, as illustrated in FIG. 1. Typically, the outlet velocity is highest proximate the center of the impeller fan blades 10 and lowest at the root and tips of the blades. Therefore, it is known in the art to provide a flow diffuser plate between the fan outlet and the resistor stack inlet. The flow diffuser plate is a flat plate 12 typically formed of metal and having a pattern of holes 14 formed there through, as illustrated in FIG. 2. In the annular ring area 16 of the plate 12 aligned with the high velocity portions of the fan airflow, the quantity and/or size of holes 14 per unit area of the plate is relatively low. In the central area 18 and corner areas 20 of the plate 12 aligned with the low velocity portions of the fan airflow, the quantity and/or size of holes 14 per unit area of the plate is relatively high. This uneven distribution of openings in the diffuser plate 12 has the effect of making the distribution of airflow volume and velocity downstream of the diffuser plate 12 much more even than that provided at the fan outlet, as illustrated in FIG. 1. The diffuser plate 12 also serves to reshape the air stream from the generally circular cross-section of the fan blades 10 to the generally rectangular cross-section of the downstream resistor grid stack 22. Thus, the cooling provided across the resistor grid stack 22 is more evenly distributed as a result of the action of the diffuser plate 12 and hot spots therein are minimized or eliminated.

Unfortunately, the prior art diffuser plate 12 is essentially a flow blocking device and it creates a significant pressure drop in the air stream, thereby reducing the total volume of cooling airflow provided through the resistor grid stack 22. To compensate for this airflow reduction, a larger and/or more powerful fan motor 2 may be provided, with the associated cost, weight and noise penalties.

SUMMARY OF THE INVENTION

Thus, there is a need for an improved locomotive dynamic braking grid package. In particular, there is a need for an air delivery system for a resistor grid stack that provides a high volume flow of air having a relatively constant cross-sectional velocity profile.

An apparatus for at least partially normalizing an axial flow velocity distribution of a flow of cooling air supplied by a fan to a locomotive dynamic braking grid resistor stack is described herein as including: a flow turning vane disposed in the flow of cooling air downstream of the fan and upstream of the resistor stack, the flow turning vane oriented within the flow of cooling air to direct a portion of the cooling air from a relatively higher velocity portion of the flow of cooling air into a relatively lower velocity portion of the flow of cooling air. The flow turning vane may include an annular member having an inside diameter dimension that decreases along an axis in the direction of the airflow for directing a portion of the cooling air from a relatively higher velocity annular portion of the flow of cooling air into a relatively lower velocity center portion of the flow of cooling air. The flow turning vane may further include a corner member disposed proximate a corner of a duct bounding the flow of cooling air for directing a portion of air from a relatively higher velocity annular portion of the flow of cooling air into a relatively lower velocity corner portion of the flow of cooling air. The apparatus may include a first flow turning vane and a second flow turning vane disposed in the flow of cooling air downstream of the first flow turning vane and upstream of the resistor stack.

A cooling apparatus for a locomotive dynamic brake resistor grid stack is described herein as including: a fan for inducing a flow of air having a cross-section with a relatively higher velocity area and a relatively lower velocity area; a duct for directing the flow of air away from the fan to an inlet to a dynamic brake resistor grid stack; and a flow directing diffuser disposed within the duct for directing a portion of the flow of air from the relatively higher velocity area into the relatively lower velocity area to at least partially normalize a flow velocity distribution of the air entering the inlet to the grid stack. The fan may be a mixed flow fan.

A locomotive dynamic braking grid package is described as including: a plurality of electrical resistors packaged in a grid stack; a fan for producing a flow of cooling air; a duct for directing the flow of cooling air from the fan to the grid stack for cooling the plurality of electrical resistors; and a flow turning vane disposed within the duct for directing a portion of the cooling air from a higher axial velocity area into a lower axial velocity area of the duct to at least partially normalize an axial flow velocity profile of the cooling air as it enters the grid stack. The fan may be a mixed flow fan.

In a further embodiment, a locomotive dynamic braking grid package is described as including: a plurality of electrical resistors packaged in a grid stack; a mixed flow fan for producing a flow of cooling air; and a duct for directing the flow of cooling air from the fan to the grid stack for cooling the plurality of electrical resistors. The locomotive dynamic braking grid package may further include an annular flow turning vane disposed within the duct for directing a portion of the cooling air from a higher axial velocity annular area into a lower axial velocity center area of the duct to at least partially normalize an axial flow velocity profile of the cooling air as it enters the grid stack.

BRIEF DESCRIPTION OF THE DRAWINGS

The features and advantages of the present invention will become apparent from the following detailed description of the invention when read with the accompanying drawings in which:

FIG. 2 is a plan view of a prior art diffuser plate showing the uneven distribution of holes formed there through.

DETAILED DESCRIPTION OF THE INVENTION

Figure 3:
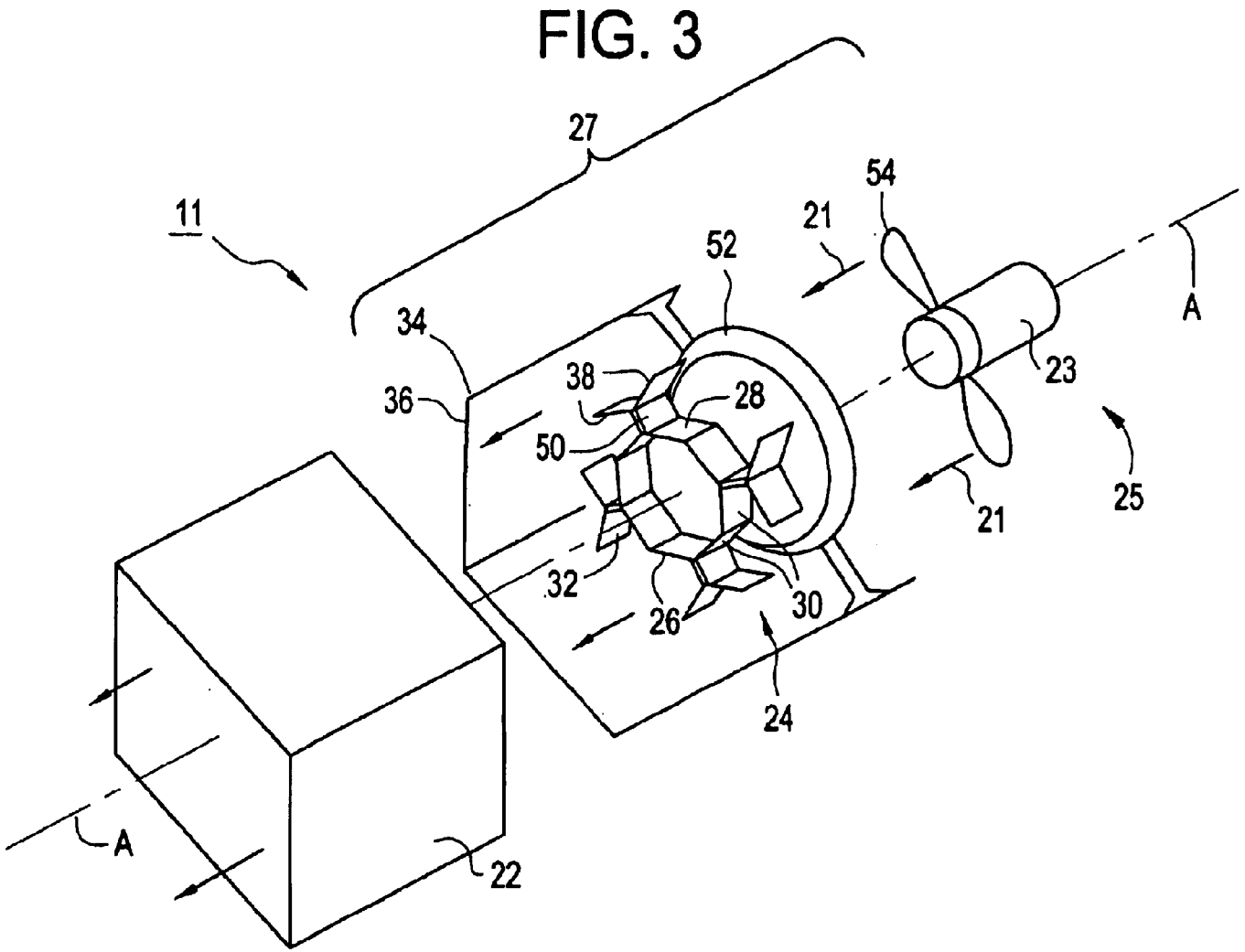
FIG. 3 is an exploded isometric view of a dynamic braking grid package including a flow directing diffuser.

The inventors have discovered that a flow directing diffuser may be used to provide the required airflow velocity distribution correction in a dynamic braking grid package 11 without creating any adverse reduction in the total volume of airflow that is generated by the fan/motor combination. One such flow directing diffuser 24 is illustrated in FIG. 3. FIG. 3 is an exploded perspective view of a dynamic braking grid package 25 including a resistor grid stack 22 disposed downstream of a fan/motor 25. The flow directing diffuser 24 is disposed between the fan/motor 25 and the resistor grid stack 22 within the stream of cooling air 21 produced by the fan/motor 25. The fan/motor 25 and the flow directing diffuser 24 function together as a cooling apparatus 27 for the resistor grid stack 22.

The flow directing diffuser 24 includes a plurality of turning vane members 26 that each function to direct a portion of the airflow traveling through the diffuser 24 away from a high velocity area and into a low velocity area. Proper selection and location of such turning vane members 26 can result in an improved flow velocity distribution together with no decrease or a small increase in the total volume of airflow provided through a dynamic braking grid when compared to the volume of airflow that would otherwise be provided by the fan/motor alone with no diffuser in place. The flow directing diffuser 24 does not block and reduce the air flow as would a prior art diffuser plate 12.

Figure 1:
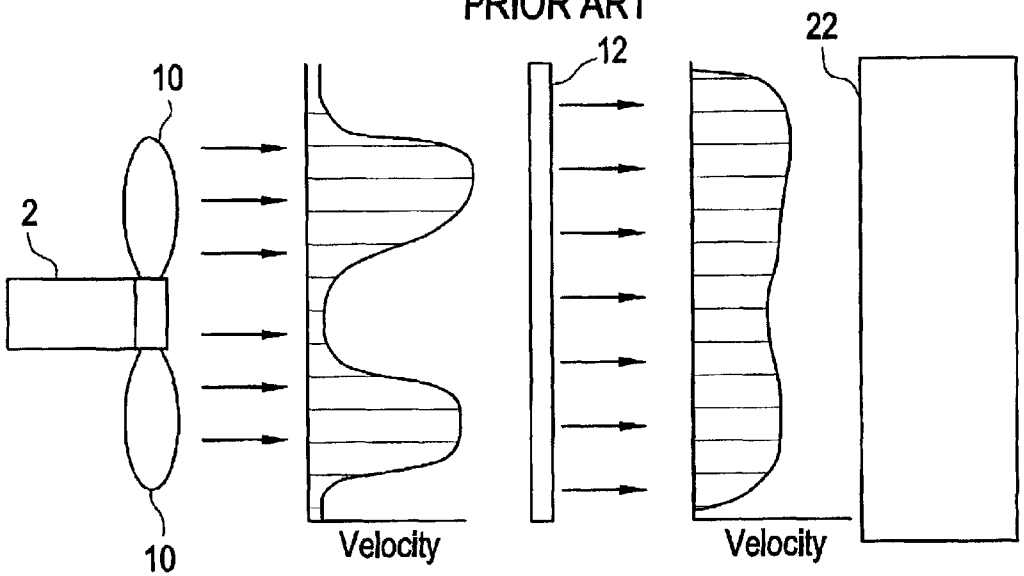
FIG. 1 PRIOR ART
FIG. 1 is a schematic illustration of a prior art dynamic braking grid package showing the cooling air velocity profile upstream and downstream of a prior art diffuser plate disposed between the fan and the resistor grid stack.
Figure 2:
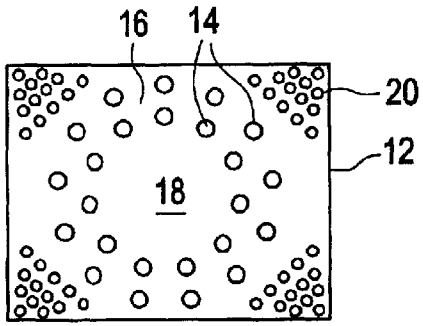
FIG. 2 PRIOR ART

In one embodiment, flow directing diffuser 24 contains two different geometries of turning vane members 26. A first turning vane member 28 is a ring-shaped annular member disposed about the axis A of the direction of flow. First turning vane member 28 is illustrated as having a generally octagonal shape and being formed from a plurality of interconnected flat plates 30. One may appreciate that a smoothly curved generally circular geometry may be used in lieu of the octagonal shape. Furthermore, the individual plates 30 or a generally circular member may be curved into an airfoil shape. The plates may be metal, such as aluminum, or fiber composite or other material known in the art. Each plate 30 is oriented at an angle with respect to the axis A so that the annular first turning vane member 28 has an inside diameter dimension measured in a direction perpendicular to the axis A that decreases along axis A in the direction of the airflow. The effect of these angled plates 30 is to redirect a portion of the air from the relatively higher velocity annular portion of the airflow into the relatively lower velocity central area. A portion of the high velocity airflow has some of its axial momentum converted into a radial velocity component, thereby moving a greater portion of the volume of the air into the central area of the air stream. Thus, the axial flow velocity profile of the air stream is at least partially normalized downstream of the flow directing diffuser 24, with the resulting velocity profile being similar to that illustrated in FIG. 1 as achievable downstream of a prior art flow blocking diffuser plate 12.

A second turning vane such as corner member 32 is associated with each of the four corners 34 of generally rectangular-shaped duct 36 surrounding and defining the shape of the air stream. Such second turning vane members 32 are illustrated as being two interconnected flat plates 38 forming a V-shape, although any variety of other shapes may be used, such as described above with respect to first turning vane member 28. Each plate is disposed at an angle relative to the axis A to become closer to duct 36 as the air progresses downstream in the direction of axis A. This angle will impart a radially outward flow velocity component to a portion of the airflow. The effect of these angled plates 38 is to redirect a portion of the air flowing along the relatively higher velocity annular portion of the airflow into the relatively lower velocity corner portion of the airflow proximate corners 34 of duct 36.

Prior art locomotive dynamic braking systems utilize axial fans to direct a flow of cooling air in an axial direction toward the resistor grids. When an axial fan encounters a static pressure sufficiently high to exceed the lift coefficient of the blade airfoil, aerodynamic breakdown of the air flow over the airfoil will occur and the total air flow generated by the fan will be dramatically reduced. Such stall conditions are a design limitation for prior art brake resistor grid cooling systems. Variables affecting the fan performance include altitude, temperature, barometric pressure, and wind speed and direction. Because the prior art cooling systems are prone to a rapid decrease in the cooling air flow rate in the event of stall conditions, such systems must be very conservatively designed to minimize such occurrences. The present inventors have found that a mixed flow fan 54 may be used advantageously in the cooling apparatus 27 of the present invention to provide additional stall margin. Fan 54 may be driven by motor 23 by a drive shaft, belt, chain or other known power transmission device. A mixed flow fan combines the features of an axial fan and a centrifugal fan and generates an axial air flow having a radial velocity component. Such a design is advantageous in the cooling apparatus 27 of the present invention, since the radial velocity component will be naturally redirected by the downstream duct 36 to increase the flow velocity proximate the corners 34 of the duct. A mixed flow fan 54 may provide a higher cooling flow than an axial flow fan with the same power consumption, or it may provide a lower power consumption with a lower noise level to produce the same total flow volume as an axial flow fan. Importantly, the near-stall performance characteristics of a mixed flow fan are well suited for this cooling application, since the total flow rate produced by a mixed flow fan will drop more gradually than an axial fan as the back pressure against the fan increases to the point of aerodynamic failure. Thus, during abnormal transient conditions, such as encountering a cross wind when operating at a high altitude, the mixed flow fan 54 of the present invention may provide a reduced but non-zero flow rate, and it will not drop precipitously to zero air flow as can possibly occur with the axial fan 10 of the prior art. The mixed flow fan 54 is thus advantageously combined with a downstream duct 36 to provide cooling air to a dynamic braking resistor grid package 22 for a locomotive. One or more turning vane members 28, 32 may be provided within the duct 36 to further equalize the flow velocity distribution at the inlet of the grid package 22.

Figure 4:
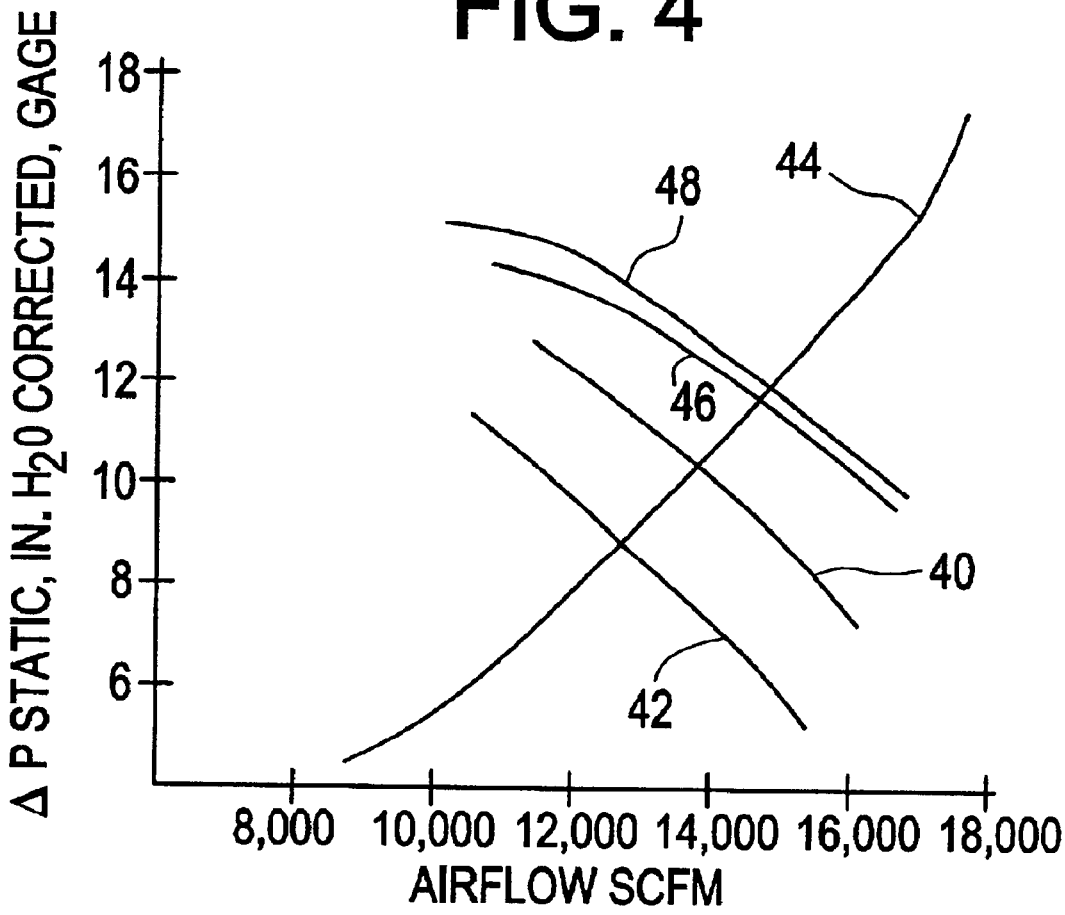
FIG. 4 is a comparison of the pressure drop performance of a dynamic braking grid package having a prior art flow blocking diffuser and a similar system having a flow directing diffuser.

The flow directing members 26 function to move a portion of the higher velocity air produced by a fan 54 into the areas of lower velocity air. This allows for improved pressure drop characteristics when compared to prior art flow blocking diffuser systems. Due to better pressure recovery, a fan operating with the flow directing diffuser 24 of the present invention may have a performance curve which is comparable to, or slightly better than, the fan operation with no diffuser. In contrast, the prior art flow blocking diffuser 12 produces a distinct pressure loss, as illustrated in FIG. 4. Curve 40 illustrates the use of a prior art axial flow fan operating at 3,600 RPM with no diffuser. Curve 42 illustrates the use of this same axial flow fan at the same speed with a prior art flow blocking diffuser plate 12. Notice that the use of the diffuser 12 results in a reduction in the total system airflow of approximately 1,000 SCFM as predicted by system curve 44. Curve 46 illustrates the use of a mixed flow fan operating at 3,600 RPM within the same size and noise envelopes as the prior art axial flow fan and with no diffuser. The mixed flow fan provides an increase in the system flow rate of over 1,000 SCFM when compared to the axial flow fan without a diffuser. Curve 48 illustrates the use of this same mixed flow fan at the same operating speed with a flow directing diffuser 24. Notice that in this embodiment, the overall system flow is slightly increased by the use of the flow directing diffuser 24.

The flow directing diffuser 24 may be formed of one or more turning vane members disposed at one or more positions along the axis A of the flow stream. First and second turning vane members 28, 32 are illustrated as being positioned at the same position along axis A with interconnecting support member 50 connected there between. A third turning vane member 52 may be positioned at a second position along axis A to cooperate with the first and second turning vane members 28, 32 in redirecting the flow of cooling air. The third turning vane member 52 is disposed in a position relative to the direction of flow of the air stream such that a portion of the higher velocity air is directed into an area of lower velocity air. Third turning vane member 52 is illustrated as having an annular ring shape disposed at an angle to axis A for directing a portion of the donut-shaped high velocity air stream into a center area within the duct 36 where the flow velocity exiting the fan blades 10 is relatively low. Thus, third turning vane member 52 and first turning vane member 28 cooperate to increase the velocity of the air stream near the center of the duct 36. Thus, the flow transition length of the present design is greater than that of a prior art single flow distribution plate design. By achieving the desired flow redistribution in two steps rather than with a single turning vane member or with a single flow distribution plate, the turbulence created in the air stream is reduced compared to a single step design, thus further improving the efficiency of the system. In one embodiment, the velocity profile across the end of the resistor grid stack 22 has about a 6% variation, thus providing a temperature variation of approximately 10% across the grid stack. This compares favorably with a prior art diffuser plate designs.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim:

1. An apparatus for at least partially normalizing an axial flow velocity distribution of a flow of cooling air supplied by a fan to a locomotive dynamic braking grid resistor stack, the apparatus comprising:

a duct bounding the flow of cooling air; and a flow turning vane comprising a corner member disposed proximate a corner of the duct and disposed remote from a center portion of the flow of cooling air and spaced apart from the duct to allow a portion of the flow of cooling air to pass between the corner member and the corner, the corner member extending into a relatively higher velocity annular portion of the flow of cooling air and having a downstream portion disposed closer to the corner than an upstream portion for directing a portion of the cooling air from the relatively higher velocity annular portion of the flow of cooling air into a relatively lower velocity corner portion of the flow of cooling air without restricting the center portion of the flow of cooling air.

2. The apparatus of claim 1, wherein the flow turning vane further comprises a V-shaped corner member having a first portion disposed in the relatively higher velocity annular portion and having a second portion extending toward the corner.

3. The apparatus of claim 1, further comprising:

an annular member disposed within the duct for directing a portion of the cooling air from the relatively higher velocity annular portion of the flow of cooling air into the center portion of the flow of cooling air; and wherein the corner member is connected to the duct and the annular member is connected to the corner member in order to provide support for both the corner member and the annular member without restricting the center portion of the flow of cooling air.

4. The apparatus of claim 3, wherein the annular member comprises a first annular member, and further comprising:

a second annular member disposed in the flow of cooling air downstream of the first annular member and upstream of the resistor stack, the second annular member cooperating with the first annular member for directing the portion of the cooling air from the relatively higher velocity annular portion of the flow of cooling air into the center portion of the flow of cooling air with reduced turbulence in the flow of cooling air than would be created by directing the same portion of the cooling air into the center portion of the flow of cooling air with only a single annular member.

5. The apparatus of claim 1, wherein the flow turning vane further comprises two interconnected flat plates forming a V-shape, each plate connected to the duct at one end and connected to the other plate at an opposed end and having a downstream portion disposed closer to the corner than an upstream portion for directing the portion of the cooling air from the relatively higher velocity annular portion of the flow of cooling air into the relatively lower velocity corner portion of the flow of cooling air without imparting tangential velocity to the flow of cooling air.

6. A cooling apparatus for a locomotive dynamic brake resistor grid stack, the cooling apparatus comprising:

a fan for inducing a flow of air having a cross-section with a relatively higher velocity annular area and a relatively lower velocity center area;

a duct for directing the flow of air away from the fan to an inlet of a locomotive dynamic brake resistor grid stack; and a flow directing vane disposed within the duct for directing a portion of the flow of air from the relatively higher velocity annular area into a corner region of the duct without restricting the relatively lower velocity center area to at least partially normalize a flow velocity distribution of the air entering the inlet of the grid stack;

wherein the flow directing vane is spaced apart from a corner of the duct and extends into the annular area with a downstream portion being disposed closer to the corner than an upstream portion for directing the portion of air from the annular area into the corner region.

7. The cooling apparatus of claim 6, wherein the fan comprises a mixed flow fan.

8. The cooling apparatus of claim 6, further comprising an annular member connected to the flow directing vane for directing a portion of the flow of air from the relatively higher velocity annular area to the relatively lower velocity center area.

9. The cooling apparatus of claim 8, wherein the annular member comprises a first annular member, and further comprising a second annular member disposed within the duct and cooperating with the first annular member to direct the portion of the flow of air from the relatively higher velocity annular area to the center area with reduced turbulence in the flow of air than would be created by directing the same portion of the air into the center area with only a single annular member.

10. The cooling apparatus of claim 6, wherein the flow directing vane further comprises two interconnected flat plates forming a V-shape, each plate connected to the duct at one end and connected to the other plate at an opposed end and having a downstream portion disposed closer to the corner than an upstream portion for directing the portion of the flow of air from the relatively higher velocity annular area into the corner region without imparting tangential velocity to the flow of air.

11. A locomotive dynamic braking grid package comprising:

a plurality of electrical resistors packaged in a grid stack;

a fan producing a flow of cooling air having a relatively higher velocity annular portion and a relatively lower velocity center portion;

a duct for directing the flow of cooling air from the fan to the grid stack for cooling the plurality of electrical resistors; and a flow turning vane disposed within the duct remote from the center portion for directing a portion of the cooling air from the higher velocity annular portion into a corner area of the duct without restricting the relatively lower velocity center portion to at least partially normalize an axial flow velocity profile of the cooling air as it enters the grid stack;

wherein the flow turning vane is spaced apart from a corner of the duct and extends into the annular portion of the flow of cooling air with a downstream portion being disposed closer to the corner than an upstream portion for directing the portion of the cooling air from the higher velocity annular portion into the corner area.

12. The locomotive dynamic braking grid package of claim 11, wherein the fan comprises a mixed flow fan.

13. The locomotive dynamic braking grid package of claim 11, wherein the flow turning vane further comprises two interconnected flat plates forming a V-shape, each plate connected to the duct at one end and connected to the other plate at an opposed end and having a downstream portion disposed closer to the corner than an upstream portion for directing the portion of the cooling air from the higher velocity annular portion into the corner area without imparting tangential velocity to the flow of cooling air.

* * * * *